US008982144B2

(12) United States Patent
Park

(10) Patent No.: US 8,982,144 B2
(45) Date of Patent: Mar. 17, 2015

(54) MULTI-PRIMARY COLOR DISPLAY DEVICE

(75) Inventor: Tae-Hyeong Park, Yongin-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 426 days.

(21) Appl. No.: 13/240,103

(22) Filed: Sep. 22, 2011

(65) Prior Publication Data

US 2012/0268476 A1 Oct. 25, 2012

(51) Int. Cl.
*G09G 5/02* (2006.01)
*G09G 3/36* (2006.01)

(52) U.S. Cl.
CPC ..... *G09G 3/3607* (2013.01); *G09G 3/3614* (2013.01); *G09G 3/3648* (2013.01); *G09G 2300/0426* (2013.01); *G09G 2300/0452* (2013.01); *G09G 2320/0223* (2013.01)
USPC ..... 345/589; 345/87; 345/98; 345/581; 349/104; 349/106; 349/108; 349/109

(58) Field of Classification Search
CPC ..... G09G 2300/0426; G09G 2300/0452; G09G 2320/0223; G09G 3/3607; G09G 3/3614; G09G 3/3648
USPC ..... 345/30, 55, 84, 87, 98–100, 1.1–111, 345/156–184, 581–589; 349/104–109
See application file for complete search history.

(56) References Cited

U.S. PATENT DOCUMENTS

2002/0024149 A1* 2/2002 Nakamura ..... 257/786
2006/0197458 A1* 9/2006 Winters et al. ..... 315/169.1
2007/0040952 A1* 2/2007 Roh et al. ..... 349/43

* cited by examiner

*Primary Examiner* — Kumar Patel
*Assistant Examiner* — Insa Sadio
(74) *Attorney, Agent, or Firm* — F. Chau & Associates, LLC

(57) ABSTRACT

A multi-primary color display device includes a unit pixel part, a plurality of data lines, a plurality of pads and a plurality of connection lines. The unit pixel part is disposed on a display area and includes at least four subpixels. The data lines extend in a first direction on display area, and are electrically connected to the subpixels. The pads are arranged in a second direction perpendicular to the first direction on a peripheral area surrounding the display area, and are electrically connected to a driving chip. The connection lines connect the data lines to the pads disposed on the peripheral area. Each of the connection lines has a same line resistance.

17 Claims, 5 Drawing Sheets

MULTI-PRIMARY COLOR DISPLAY DEVICE

PRIORITY STATEMENT

This application claims priority under 35 U.S.C. §119 from Korean Patent Application No. 2011-36201, filed on Apr. 19, 2011 in the Korean Intellectual Property Office (KIPO), the contents of which are herein incorporated by reference in their entirety.

BACKGROUND

1. Technical Field

Exemplary embodiments of the present disclosure are directed to a display device. More particularly, exemplary embodiments of the present disclosure are directed to a multi-primary color display device including a multi-primary subpixel.

2. Description of the Related Art

In general, a liquid crystal display (LCD) apparatus includes an LCD panel, a data driver and a gate driver. The LCD panel includes an array substrate, a color filter substrate and a liquid crystal layer. The array substrate includes a plurality of data lines, a plurality of gate lines, a plurality of switching elements and a plurality of pixel electrodes. The color filter substrate includes a plurality of color filters and a common electrode facing the pixel electrodes. The liquid crystal layer is disposed between the array substrate and the color filter substrate, and liquid crystals are arranged by an electric field between the pixel electrode and the common electrodes.

As described above, to reduce image crosstalk and flicker due to driving the LCD panel, an inversion driving method may be used that reverses a polarity of a data voltage applied to the pixel.

In general, the LCD panel has an RGB structure that includes red, green and blue subpixels. An LCD panel having an RGB structure may use a one-dot inversion driving method. In a one-dot inversion driving method, the voltages are applied to the subpixels in an order of positive (+), negative (−), positive (+) and negative (−) voltages. Thus, positive (+) and negative (−) voltages may be uniformly applied to red, green and blue subpixels during one frame.

Recently, to improve color reproduction and luminance of an LCD panel, an LCD panel having an RGBW structure including red, green, blue and white subpixels, and a multi-primary color display device including red, green, blue subpixels and an additional color subpixel, such as yellow, cyan or magenta, have been developed. For example, when the one-dot inversion driving method is applied to an LCD panel including red, green, blue and white subpixels arranged in one row, the red subpixels are only provided with the positive (+) voltage, the green subpixels are only provided with the negative (−) voltage, the blue subpixels are only provided with the positive (+) voltage and the white subpixels are only provided with the negative (−) voltage. Therefore, the same color subpixels are provided with the same polarity voltage. However, display deterioration, such as striped patterns due to image crosstalk, may occur.

SUMMARY

Exemplary embodiments of the present disclosure provide a multi-primary color display device including a multi-primary subpixel which improves display quality and driving reliability.

According to an exemplary embodiment of the present disclosure, a multi-primary color display device includes a unit pixel part, a plurality of data lines, a plurality of pads and a plurality of connection lines. The unit pixel part is disposed on a display area and includes at least four subpixels. The data lines extend in a first direction on display area, and are electrically connected to the subpixels. The pads are arranged in a second direction substantially perpendicular to the first direction on a peripheral area surrounding the display area, and are electrically connected to a driving chip. The connection lines connected the plurality of data lines to the plurality of pads disposed on the peripheral area. Each of the connection lines has a same line resistance.

In an exemplary embodiment, the unit pixel part may include a red subpixel, a green subpixel, a blue subpixel and a multi-primary subpixel.

In an exemplary embodiment, the multi-primary subpixel may represent at least one of white, yellow, cyan or magenta.

In an exemplary embodiment, the plurality of data lines includes first, second, third, and fourth data lines. The red subpixel may be electrically connected to the first data line, the green subpixel may be electrically connected to the second data line, the blue subpixel may be electrically connected to the third data line and the multi-primary subpixel may be electrically connected to the fourth data line.

In an exemplary embodiment, the plurality of pads includes first, second, third, and fourth pads and the plurality of connection lines includes first, second, third, and fourth connection lines. The first connection line electrically may connect the first data line to the first pad, the second connection line may electrically connect the second data line to the second pad, the third connection line may electrically connect the third data line to the third pad, and the fourth connection line may electrically connect the fourth data line to the fourth pad.

In an exemplary embodiment, the first, second, third and fourth pads may be arranged along a diagonal with respect to the first direction.

In an exemplary embodiment, each of the first, second, third and fourth pads has a first side and a second side opposite to the first side, the first sides and the second sides of the pads extend parallel with each other along said first direction, and a distance between two adjacent sides in the second direction may be less than a pixel width.

In an exemplary embodiment, the first, second, third and fourth pads may be arranged along the first direction.

In an exemplary embodiment, the first connection line has a first length and a first width, the second connection line has a second length greater than the first length and a second width greater then the first width, the third connection line has a third length greater than the second length and a third width greater than the second width, and the fourth connection line has a fourth length greater than the third length and a fourth width greater than the third width.

In an exemplary embodiment, the driving chip may uniformly provide data voltages of a positive polarity (+) and a negative polarity (−) with respect to a reference voltage to the same color subpixels during one frame.

In an exemplary embodiment, the driving chip may provide voltages having an inversion period of positive (+), negative (−), positive (+), negative (−), negative (−), positive (+), negative (−) and positive (+), or negative (−), positive (+), negative (−), positive (+), positive (+), negative (−), positive (+) and negative (−), to the subpixels included in at least two unit pixel parts.

According to another exemplary embodiment of the present disclosure, a multi-primary color display device includes a unit pixel part and a plurality of pads. The unit pixel part is disposed on a display area, and includes a red subpixel, a green subpixel, a blue subpixel and at least one multi-primary subpixel. The pads are arranged in first direction on a peripheral area surrounding the display area that are electrically connected to a driving chip and to the subpixels. Each subpixel is associated with a pad. The plurality of pads includes first, second, third, and fourth pads. Each of the first, second, third and fourth pads has a first side and a second side opposite to the first side. The first and second sides of the pads extend parallel with each other along a second direction substantially perpendicular to the first direction, and a distance between two first sides of adjacent pads in the first direction is less than a pixel width.

In an exemplary embodiment, the multi-primary color display device may include a plurality of data lines extending in the second direction on the display area that are electrically connected to the subpixels, including first, second, third, and fourth data lines. The red subpixel may be electrically connected to the first data line, the green subpixel may be electrically connected to the second data line, the blue subpixel may be electrically connected to the third data line and the multi-primary subpixel may be electrically connected to the fourth data line.

In an exemplary embodiment, the multi-primary color display device may include a plurality of connection lines that includes first, second, third, and fourth connection lines. The first connection line may electrically connect the first data line to the first pad, the second connection line may electrically connect the second data line to the second pad, the third connection line may electrically connect the third data line to the third pad, and the fourth connection line may electrically connect the fourth data line to the fourth pad. Each of the connection lines may have a same line resistance.

In an exemplary embodiment, the first connection line may have a first length and a first width, the second connection line may have a second length greater than the first length and a second width greater then the first width, the third connection line may have a third length greater than the second length and a third width greater than the second width, and the fourth connection line may have a fourth length greater than the third length and a fourth width greater than the third width.

According to embodiments of the present disclosure, data lines disposed in a display area and pads disposed in a peripheral area are connected to connection lines having the same line resistance, to prevent signal distortion. In addition, the pads are arranged in a plurality of rows so that a contact area of the pads with bumps of the data driving chip may be increased to improve driving reliability.

DETAILED DESCRIPTION OF EXEMPLARY EMBODIMENTS

Hereinafter, the present disclosure will be explained in detail with reference to the accompanying drawings.

Figure 1:
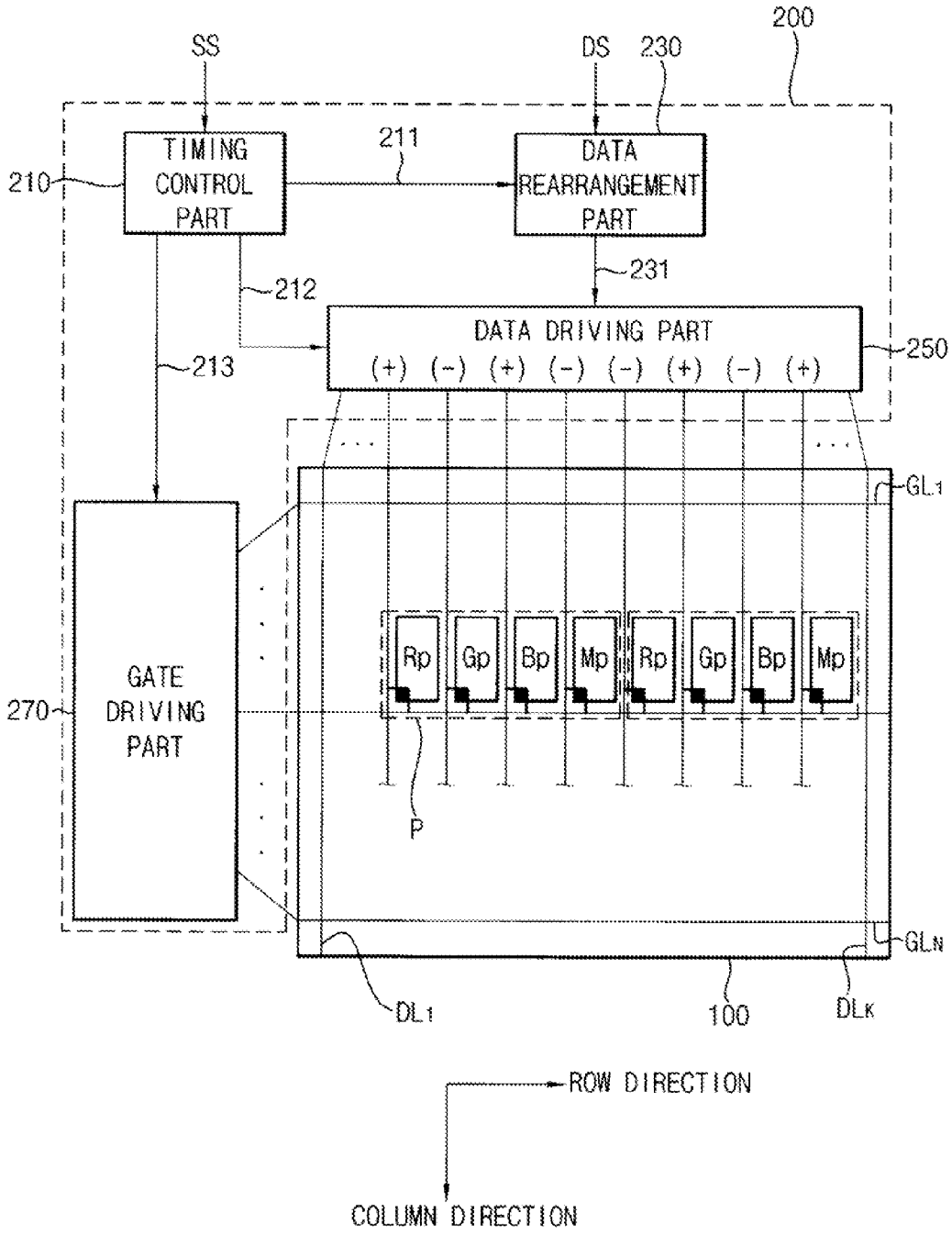
FIG. 1 is a block diagram illustrating a display device according to an exemplary embodiment of the present disclosure.

FIG. 1 is a block diagram illustrating a display device according to an exemplary embodiment of the present disclosure.

Referring to FIG. 1, the display device includes a display panel 100 and a panel driving part 200.

The display panel 100 includes a plurality of unit pixel parts P, a plurality of data lines $DL_1, \ldots, DL_K$ (K is a natural number) extending in a first direction and a plurality of gate lines $GL_1, \ldots, GL_N$ (N is a natural number) extending in a second direction substantially perpendicular to the first direction. According to exemplary embodiments, the plurality of data lines may be arranged in columns, and the plurality of gate lines may be arranged in rows, however, these embodiments are non-limiting, and in other exemplary embodiments, the reverse may be true. Each of the unit pixel parts P includes a main color subpixel and a multi-primary subpixel. The main color subpixel includes red, green and blue subpixels Rp, Gp and Bp, and the multi-primary subpixel Mp may include at least one of a white, yellow, cyan, or magenta subpixel, etc. The white subpixel may be a clear subpixel which lacks a color filter. When the display panel 100 includes the multi-primary subpixels Mp, the multi-primary subpixel may display various colors that improve the display panel luminance and increase the color reproduction range. Each of the subpixels includes a switching element (not shown) connected to the data line and the gate line and a pixel electrode connected to the switching element.

Each of the subpixels Rp, Gp, Bp or Mp may have a pixel size corresponding to a pixel area that may be equal to or different from the remaining subpixels. The red subpixel Rp and the blue subpixel Bp may have the same pixel size. The green subpixel Gp and the multi-primary subpixel Mp may have different pixel sizes. The red subpixel Rp may have a greater pixel size than that of each of the green subpixel Grp and the multi-primary subpixel Mp.

Each of the subpixels Rp, Gp, Bp and Mp includes an aperture area AA that substantially transmits light. The aperture area AA may be less than or equal to the pixel size of the subpixel. The aperture area AA of at least one of the subpixels may be different from the remaining subpixels. An aperture ratio of at least one of the subpixels may be different from the remaining subpixels.

The pixel size and the aperture area of the red subpixel Rp may be greater than or equal to those of each of the blue subpixel Bp, the green subpixel Gp, and the multi-primary subpixel Mp.

The pixel size and the aperture area of the blue subpixel Bp may be greater than or equal to those of each of the green subpixel Gp and the multi-primary subpixel Mp. The pixel size and the aperture area of the green subpixel Gp may be greater than or equal to those of the multi-primary subpixel Mp.

The pixel size and the aperture area of the multi-primary subpixel Mp may be less than or equal to those of at least one of the red, blue or green subpixels Rp, Gp and Bp. The red subpixel Rp may have the greatest aperture area of the subpixels Rp, Gp, Bp and Mp. The aperture areas of the subpixels Rp, Gp, Bp and Mp may decrease in size in order of the red subpixel Rp, the blue subpixel Bp, the green subpixel Gp and the multi-primary subpixel Mp.

In addition, the aperture area at of least one of the red subpixel Rp and the blue subpixel Bp may be greater than the aperture area of the multi-primary subpixel Mp. For example, when the multi-primary subpixel Mp is yellow, the aperture area of least one of the red subpixel Rp and the blue subpixel Bp may be greater than the aperture area of the yellow subpixel. The pixel size and the aperture area of the subpixels Rp, Gp, Bp and Mp are not limited thereto and may be varied to improve white level uniformity or increase the color reproduction range.

The panel driving part 200 includes a timing control part 210, a data rearrangement part 230, a data driving part 250, and a gate driving part 270.

The timing control part 210 generates timing signals 211, 212 and 213 based on a received synchronization signal SS and uses these timing signals 211, 212 and 213 to respectively control a driving timing of the data rearrangement part 230, the data driving part 250 or the gate driving part 270.

The data rearrangement part 230 generates red, green, blue and multi-primary data 231 using received red, green and blue data DS, rearranges the red, green, blue and multi-primary data 231 according to a subpixel structure of the display panel 100 and outputs the rearranged red, green, blue and multi-primary data 231 to the display panel 100.

The data driving part 250 converts the red, green, blue and multi-primary data into red, green, blue and multi-primary data voltages using gamma voltages. The data driving part 250 outputs data voltages having a first polarity with respect to a reference voltage or a second polarity with respect to the reference voltage. The first polarity may be referred to as a positive polarity (+), the second polarity may be referred to as a negative polarity (−) and the reference voltage may be referred to as a common voltage Vcom. The data driving part 250 outputs to the data lines corresponding to adjacent two unit pixel parts data voltages having a positive (+), negative (−), positive (+), negative (−), negative (−), positive (+), negative (−) and positive (+) inversion period, or a negative (−), positive (+), negative (−), positive (+), positive (+), negative (−), positive (+) and negative (−) inversion period. In addition, the data driving part 250 reverses the data voltages being output for each horizontal period.

The gate driving part 270 may generate a plurality of gate signals and may sequentially output the gate signals to the gate lines $GL_1, \ldots, GL_N$.

Figure 2:
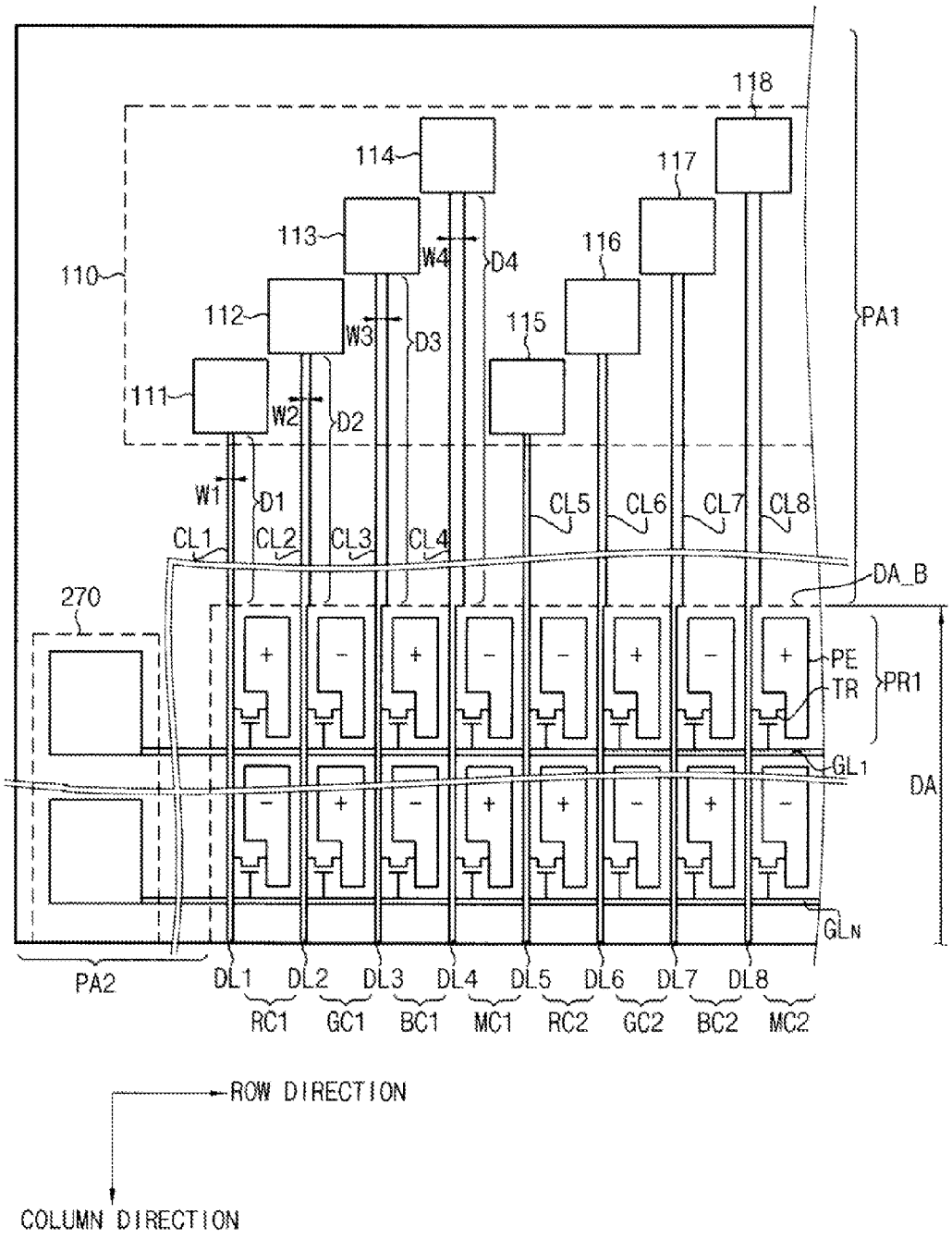
FIG. 2 is a plan view illustrating a display panel of FIG. 1.

FIG. 2 is a plan view illustrating a display panel of FIG. 1.

Referring to FIGS. 1 and 2, the display panel 100 includes a display area DA and a peripheral areas PA1, PA2 surrounding the display area DA.

A plurality of subpixels is disposed on the display area DA. The subpixels include a plurality of main color subpixels and at least one multi-primary subpixel. For example, the main color subpixels may include red, green and blue subpixels and the multi-primary subpixel may include at least one of a white, yellow, cyan or magenta subpixel.

Each of the subpixels may include a switching element TR, a pixel electrode PE and a color filter (not shown). The switching element TR is connected to the data line, the gate line and the pixel electrode PE. The color filter may be disposed on an area on which the pixel electrode PE is disposed. The color filter may include main color filters including red, green and blue and a multi-primary filter including at least one of yellow, cyan or magenta. When the multi-primary subpixel is a white subpixel, the color filter may be omitted.

For example, the red subpixels in a first red pixel column RC1 of a first group of columns are electrically connected to a first data line DL1 and to gate lines $GL_1, \ldots, GL_N$ and each of the red subpixels include a red filter. The green subpixels in a first green pixel column GC1 of the first group of columns are electrically connected to a second data line DL2 and to gate lines $GL_1, \ldots, GL_N$ and each of the green subpixels include a green filter. The blue subpixels in a first blue pixel column BC1 of the first group of columns are electrically connected to a third data line DL3 and to gate lines $GL_1, \ldots, GL_N$ and each of the blue subpixels include a blue filter. The multi-primary subpixels in a first multi-primary pixel column MC1 of the first group of columns are electrically connected to a fourth data line DL4 and to gate lines $GL_1, \ldots, GL_N$ and each of the multi-primary subpixels include a multi-primary filter.

The red subpixels in a second red pixel column RC2 of a second group of columns are electrically connected to a fifth data line DL5 and to gate lines $GL_1, \ldots, GL_N$ and each of the red subpixels include a red filter. The green subpixels in a second green pixel column GC2 of the second group of columns are electrically connected to a sixth data line DL6 and to gate lines $GL_1, \ldots, GL_N$ and each of the green subpixels include a green filter. The blue subpixels in a second blue pixel column BC2 of the second group of columns are electrically connected to a seventh data line DL7 and to gate lines $GL_1, \ldots, GL_N$ and each of the second blue subpixels include a blue filter. The multi-primary subpixels in a second multi-primary pixel column MC2 of the second group of columns are electrically connected to an eighth data line DL8 and to gate lines $GL_1, \ldots, GL_N$ and each of the second multi-primary subpixels include a multi-primary filter.

A data pad part 110 and a plurality of connection lines CL1, CL2, CL3, . . . , are disposed on a first peripheral area PA1. The data pad part 110 includes a plurality of data pads 111, 112, 113, . . . that are electrically connected to the data driving part 250. The connection lines CL1, CL2, CL3, . . . connect the data pads 111, 112, 113, . . . to the data lines DL1, . . . , DLK. The data driving part 250 may be a data driving chip or a tape carrier package (TCP) which includes the data driving chip mounted on a flexible printed circuit board (FPCB).

The gate driving part 270 is disposed on a second peripheral area PA2. The gate driving part 270 may be a shift-register including a plurality of circuit switching elements and may be formed via substantially a same process as is used to form the switching elements TR of the display area DA. In exemplary embodiment, the gate driving part 270 including the circuit switching elements is disposed on the second peripheral area PA2, and a plurality of gate pads electrically connected with a plurality of bumps of the gate driving part may be disposed on the second peripheral area PA2.

The data pads 111, 112, 113, . . . , may be arranged in a plurality of rows corresponding to the number of the subpixels included in a unit pixel part P of the display area PA. When a unit pixel part includes four subpixels, such as red, green, blue and multi-primary subpixels, the data pads are arranged in four rows. Four pads corresponding to the red, green, blue and multi-primary pixel columns of each group may be arranged along a diagonal with respect to the column direction.

For example, the data pad part 110 is disposed on the first peripheral area PA1. The data pad part 110 includes a first pad 111 connected to the first data line DL1, a second pad 112 connected to the second data line DL2, a third pad 113 connected to the third data line DL3, a fourth pad 114 connected to the fourth data line DL4, a fifth pad 115 connected to the fifth data line DL5, a sixth pad 116 connected to the sixth data line DL6, a seventh pad 117 connected to the seventh data line DL7, and an eighth pad 118 connected to the eighth data line DL8.

The first pad 111 and the fifth pad 115 are arranged in a first row. The second pad 112 and the sixth pad 116 are arranged in a second row located above the first row. The third pad 113 and the seventh pad 117 are arranged in a third row located above the second row. The fourth pad 114 and the eighth pad 118 are arranged in a fourth row located above the third row.

The first to fourth pads 111, 112, 113 and 114 are arranged along a first diagonal, and the fifth to eighth pads 115, 116, 117 and 118 are arranged along a second diagonal. The first and second diagonals may be parallel to each other.

The first and fifth pads 111 and 115 in the first row are separated from pixels in a first pixel row PR1 of the display area DA by a first distance D1. The second and sixth pads 112 and 116 in the second row are separated from pixels in the first pixel row PR1 by a second distance D2 greater that the first distance D1. The third and seventh pads 113 and 117 in the third row are separated from pixels in the first pixel row PR1 by a third distance D3 greater that the second distance D2. The fourth and eighth pads 114 and 118 in the fourth row are separated from pixels in the first pixel row PR1 by a fourth distance D4 greater that the third distance D3. Alternatively, the first and fifth pads 111 and 115 of the first row are vertically separated from a boundary DA_B of the display area DA adjacent to the first pixel row PR1 by the first distance D1. The second and sixth pads 112 and 116 of the second row are vertically separated from the boundary DA_B by the second distance D2 greater than the first distance D1, the third and seventh pads 113 and 117 are vertically separated from the boundary DA_B by the third distance D3 greater than the second distance D2, and the fourth and eighth pads 114 and 118 are vertically separated from the boundary DA_B by the fourth distance D4 greater than the third distance D3.

The connection lines includes a first connection line CL1, a second connection line CL2, a third connection line CL3, a fourth connection line CL4, a fifth connection line CL5, a sixth connection line CL6, a seventh connection line CL7 and an eighth connection line CL8. The first connection line CL1 connects the first data line DL1 to the first pad 111, the second connection line CL2 connects the second data line DL2 to the second pad 112, the third connection line CL3 connects the third data line DL3 to the third pad 113, the fourth connection line CL4 connects the fourth data line DL4 to the fourth pad 114, the fifth connection line CL5 connects the fifth data line DL5 to the fifth pad 115, sixth connection line CL6 connects the sixth data line DL6 to the sixth pad 116, the seventh connection line CL7 connects the seventh data line DL7 to the seventh pad 117 and the eighth connection line CL8 connects the eighth data line DL8 to the eighth pad 118.

In exemplary embodiment, the first connection line CL1 has a first length D1, the second connection line CL2 has a second length D2 greater than the first length D1, the third connection line CL3 has a third length D3 greater than the second length D2 and the fourth connection line CL4 has a fourth length D4 greater than the third length D3.

The first to fourth connection lines CL1, CL2, CL3 and CL4 each have a different line width to maintain a common line resistance. When a line length of one of the first to fourth connection lines CL1, CL2, CL3 and CL4 is increased, the line width of the lengthened connection line may be increased to maintain the same line resistance.

For example, the first connection line CL1 has a first width W1, the second connection line CL2 has a second width W2 greater than the first width W1, the third connection line CL3 has a third width W3 greater than the second width W2, and the fourth connection line CL4 has a fourth width W4 greater than the third width W3. As described above, each of the fifth to eighth connection lines CL5, CL6, CL7 and CL8 also has a different width to maintain the same line resistance.

The connection lines connected to the pads arranged in the rows have differing lengths and widths to maintain the same line resistance. Therefore, signal distortion through the data lines may be substantially prevented.

Figure 3:
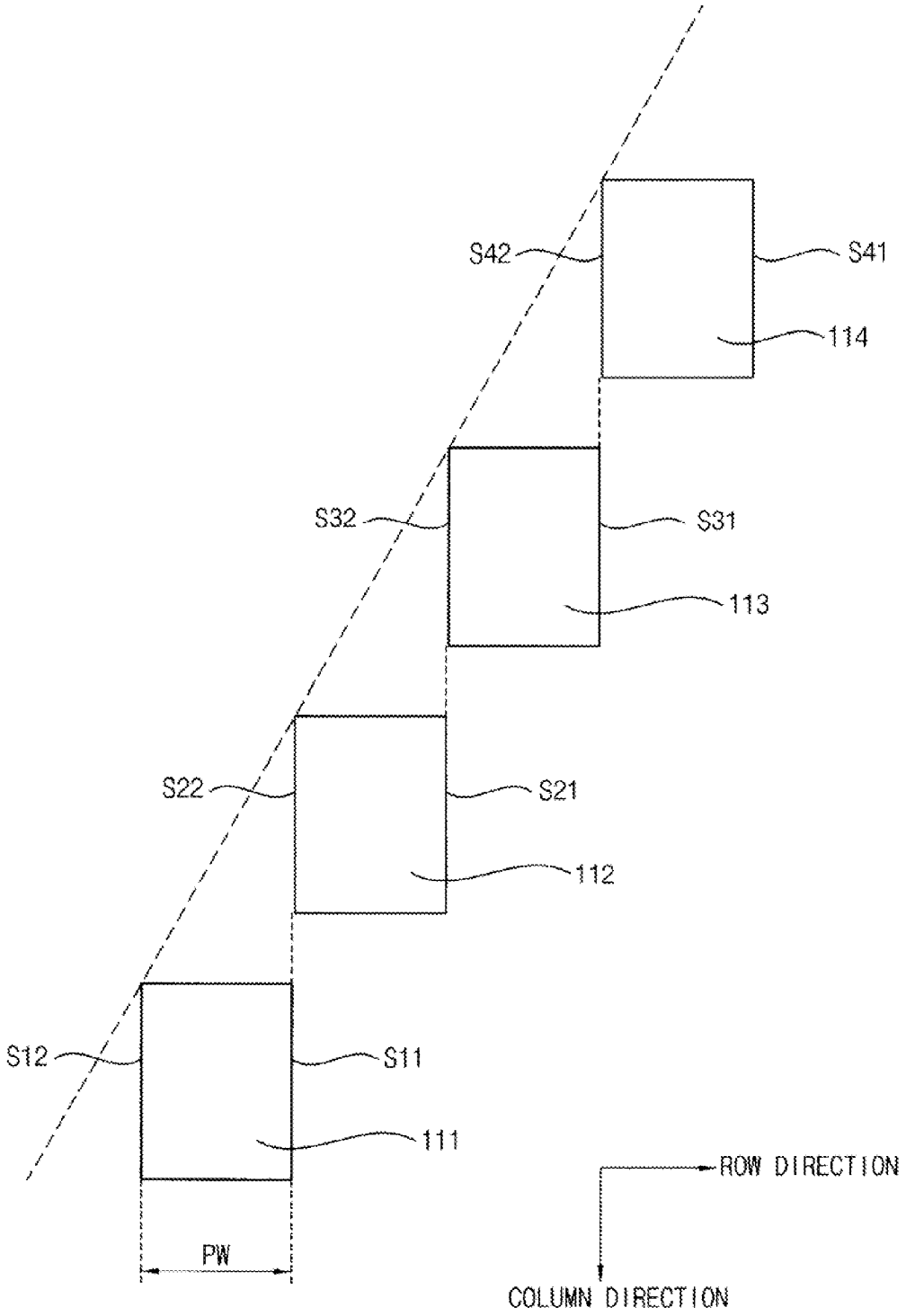
FIG. 3 is a schematic diagram illustrating the data pad part of FIG. 2.

FIG. 3 is a schematic diagram illustrating the data pad part of FIG.2.

Referring to FIGS. 2 and 3, the first pad 111, the second pad 112, the third pad 113 and the fourth pad 114 respectively corresponding to the red, green, blue and multi-primary pixel columns RC1, GC1, BC1 and MC1 of each group, are arranged along a diagonal.

The first to fourth pads 111, 112, 113 and 114 all have the same size, with each of the first to fourth pads 111, 112, 113 and 114 having a first side in the column direction and a second side opposite to the first side. In other words, the first to fourth pads 111, 112, 113 and 114 have the same pad width PW along the row direction, the first pad 111 has first and second sides S11 and S12, the second pad 112 has first and second sides S21 and S22, the third pad 113 has first and second sides S31 and S32, and the fourth pad 114 has first and second sides S41 and S42.

The first side S11 of the first pad 111 and the second side S22 of the second pad 112 are vertically separated from each other. The first side S21 of the second pad 112 and the second side S32 of the third pad 113 are vertically separated from each other. The first side S31 of the third pad 113 and the second side S42 of the fourth pad 114 are vertically separated from each other.

In exemplary embodiment, the first to fourth pads 111, 112, 113 and 114 are arranged in four rows along a diagonal so that the size of each of the pads may be increased. Thus, a contact area of the pad with a bump of the data driving part 250 may be increased to improve driving reliability.

Figure 4:
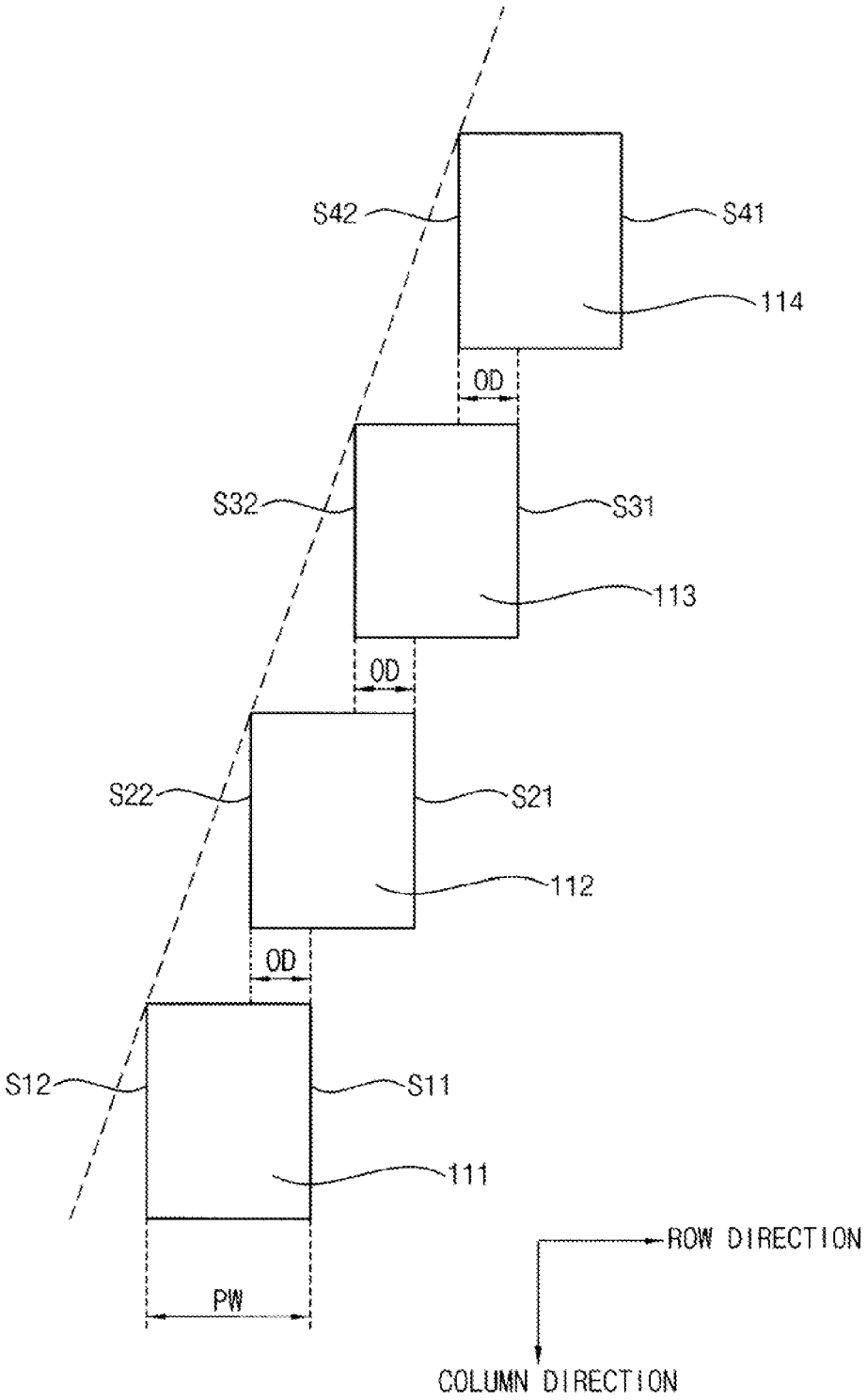
FIG. 4 is a schematic diagram illustrating a data pad part according to another exemplary embodiment of the present disclosure.

FIG. 4 is a schematic diagram illustrating a data pad part according to another exemplary embodiment of the present disclosure.

Referring to FIGS. 2 and 4, the first pad 111, the second pad 112, the third pad 113 and the fourth pad 114 respectively corresponding to the red, green, blue and multi-primary pixel columns RC1, GC1, BC1 and MC1 of each group, are arranged along a diagonal.

The first to fourth pads 111, 112, 113 and 114 all have the same pad width PW, the first pad 111 has a first side S11 and a second side S12 opposite to the first side S11, the second pad 112 has a first side S21 and a second side S22 opposite to the first side S21, the third pad 113 has a first side S31 and a second side S32 opposite to the first side S31 and the fourth pad 114 has a first side S41 and a second side S42 opposite to the first side S41.

The second side S22 of the second pad 112 is located on a vertical line displaced from the first side S11 toward the second side S12 of the first pad 111 by an overlap distance OD. The first pad 111 and the second pad 112 thus overlap each other by the overlap distance OD.

The second side S32 of the third pad 113 is located on a vertical line displaced from the first side S21 toward the second side S22 of the second pad 112 by the overlap distance OD. The second pad 112 and the third pad 113 thus overlap each other by the overlap distance OD.

The second side S42 of the fourth pad 114 is located on a vertical line displaced from the first side S31 toward the second side S32 of the third pad 113 by the overlap distance OD. The third pad 113 and the fourth pad 114 thus overlap each other by the overlap distance OD. In other words, the first sides S11, S21, S31 and S41, and the second sides S12, S22, S32 and S42 of the first to fourth pads 111, 112, 113 and 114 are respectively located on vertical lines parallel with each other that are separated by a distance less than the pixel width PW.

As described above, each of the first to fourth pads 111, 112, 113 and 114 along a diagonal may overlap an adjacent pad by the overlap distance OD.

In exemplary embodiment, the first to fourth pads 111, 112, 113 and 114 are arranged in four rows along a diagonal so that the size of each of the pads may be increased. Thus, a contact area of the pad with a bump of the data driving part 250 may be increased to improve reliability of the display device.

As described in FIGS. 3 and 4, the overlap distance OD between the first pad 111 and the second pad 112 adjacent to the first pad 111 may be greater than or equal to 0 and less than or equal to the pad width PW: 0≤OD≤PW.

Figure 5:
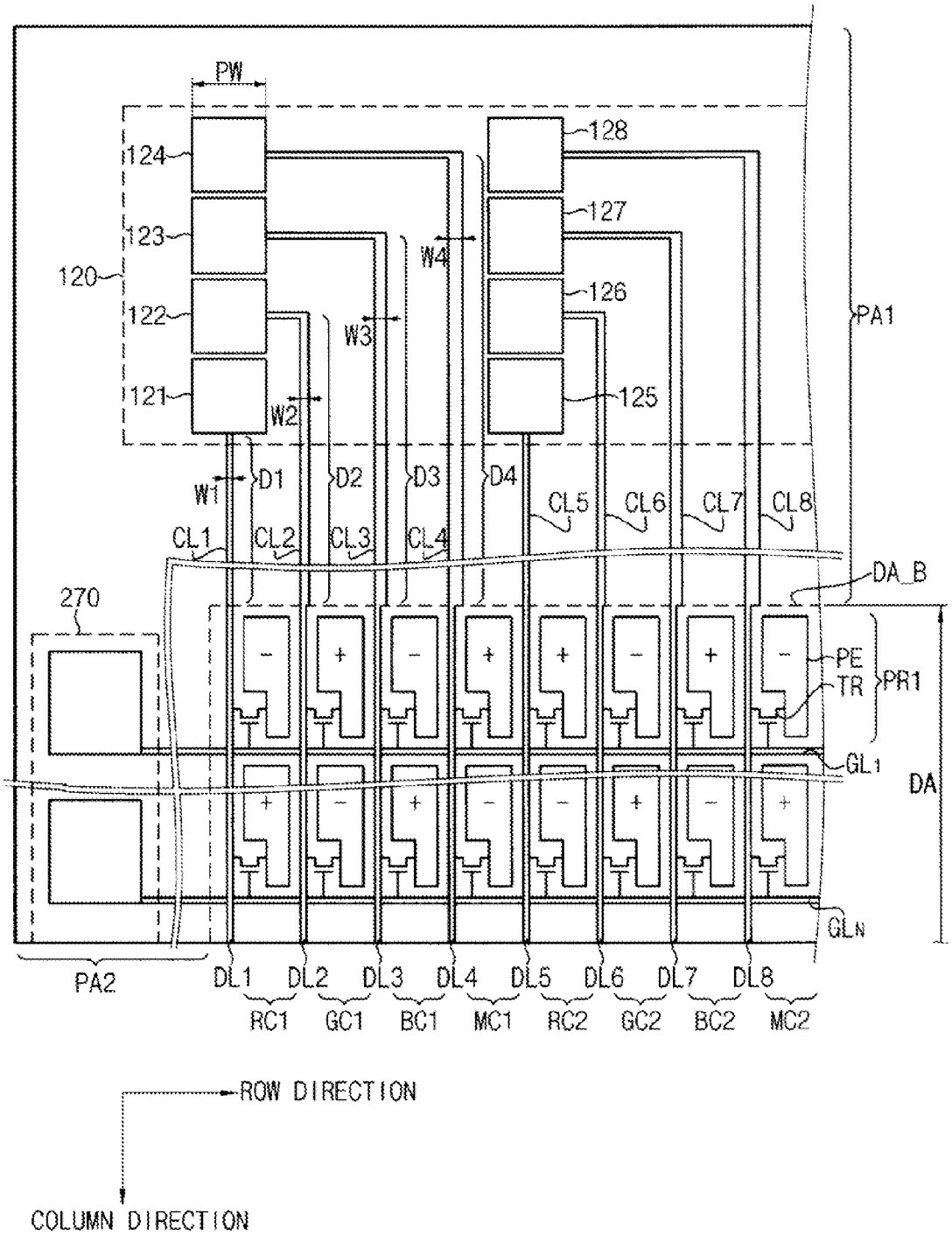
FIG. 5 is a plan view illustrating a display panel according to still another exemplary embodiment of the present disclosure.

FIG. 5 is a plan view illustrating a display panel according to still another exemplary embodiment of the present disclosure.

Referring to FIGS. 1 and 5, the display panel 100 may include a display area DA and peripheral areas PA1 and PA2 surrounding the display area DA.

A plurality of subpixels is disposed on the display area DA. The subpixels include a main subpixel and a multi-primary subpixel. For example, the main color subpixel includes red, green and blue subpixels, and the multi-primary subpixel includes at least one of a white, yellow, cyan or magenta subpixel.

Each subpixel includes a switching element TR, a pixel electrode PE and a color filter. The switching element TR is connected to a data line, a gate line and the pixel electrode PE. The color filter is disposed on an area in which the pixel electrode PE is disposed. The color filter may include a main color filter including red, green and blue filters and a multi-primary filter including yellow, cyan or magenta filters. Alternatively, when the multi-primary subpixel is white, the white subpixel may be a clear subpixel that lacks a color filter.

For example, the red subpixels in a first red pixel column RC1 of a first group of columns are electrically connected to a first data line DL1 and to gate lines $GL_1, \ldots, GL_N$ and each of the red subpixels includes a red filter. The green subpixels in a first green pixel column GC1 of the first group of columns are electrically connected to a second data line DL2 and to gate lines $GL_1, \ldots, GL_N$ and each of the green subpixels includes a green filter. The blue subpixels in a first blue pixel column BC1 of the first group of columns are electrically connected to a third data line DL3 and to gate lines $GL_1, \ldots, GL_N$ and each of the blue subpixels includes a blue filter. The multi-primary subpixels in a first multi-primary pixel column MC1 of the first group of columns are electrically connected to a fourth data line DL4 and to gate lines $GL_1, \ldots, GL_N$ and each of the multi-primary subpixels includes a multi-primary filter.

Subpixels included in red, green, blue and multi-primary pixel columns RC2, GC2, BC2 and MC2 of a second group of columns are electrically connected to fifth, sixth, seventh and eighth data lines DL5, DL6, DL7 and DL8, respectively, and to gate lines $GL_1, \ldots, GL_N$.

A data pad part 120 and a plurality of connection lines CL1, CL2, CL3, . . . are disposed on the first peripheral area PA1. The data pad part 120 includes a plurality of pads 121, 122, 123, . . . electrically connected to the data driving part 250. The connection lines CL1, CL2, CL3, . . . , connect the pads 121, 122, 123, . . . of the data pad part 120 and to data lines DL1, . . . , DLK. The data pad part 120 may be disposed on an area in which the data driving part 250 (the data driving chip) is mounted. The gate driving part 270 is disposed on the second peripheral area PA2. Alternatively, a plurality of gate pads may be disposed on the second peripheral area PA2 in contact with a plurality of bumps on a gate driving chip.

The data pads may be arranged in a plurality of rows corresponding to the number of the subpixels included in the unit pixel part of the display area DA.

For example, when the unit pixel part includes red, green, blue and multi-primary subpixels, i.e., four subpixels, the data pads are arranged in four rows, and four pads corresponding to the red, green, blue and multi-primary pixel columns RC1, GC1, BC1 and MC1 of each group are arranged in a column.

The data pad part 120 includes a first pad 121 connected to the first data line DL1, a second pad 122 connected to the second data line DL2, a third pad 123 connected to the third data line DL3, a fourth pad 124 connected to the fourth data line DL4, a fifth pad 125 connected to the fifth data line DL5, a sixth pad 126 connected to the sixth data line DL6, a seventh pad 127 connected to the seventh data line DL7 and an eighth pad 128 connected to the eighth data line DL8.

The first and fifth pads 121 and 125 are arranged in a first row. The second and sixth pads 122 and 126 are arranged in a second row above the first row. The third and seventh pads 123 and 127 are arranged in a third row above the second row. The fourth and eighth pads 124 and 128 are arranged in a fourth row above the third row.

The first to fourth pads 121, 122, 123 and 124 are arranged in a first column. The fifth to eighth pads 125, 126, 127 and 128 are arranged in a second column. The first and second columns may be parallel with each other.

The second pad 122 adjacent to the first pad 121 overlaps the first pad 121 by an overlap distance OD equal to the pad width PW so that the first and second pads 121, 122 are in a straight column.

According to exemplary embodiments described in FIGS. 3, 4 and 5, the second pad of the second row adjacent to the first row overlaps the first pad by an overlap distance OD which is greater than or equal to 0 and less than or equal to a pad width PW: 0≤OD≤PW.

The first and fifth pads 121 and 125 in the first row are separated from a first pixel row PR1 of the display area DA by a first distance D1. The second and sixth pads 122 and 126 in the second row are separated from the first pixel row PR1 by a second distance D2 greater than the first distance D1. The third and seventh pads 123 and 127 in the third row are separated from the first pixel row PR1 by a third distance D3 greater than the second distance D2. The fourth and eighth pads 114 and 118 in the fourth row are separated from the first pixel row PR1 by a fourth distance D4 greater than the third distance D3. Alternatively, the first and fifth pads 121 and 125 of the first row are vertically separated from a boundary DA_B of the display area DA adjacent to the first pixel row PR1 by the first distance D1. The second and sixth pads 122 and 126 of the second row are vertically separated from the boundary DA_B by the second distance D2 greater than the first distance D1, the third and seventh pads 123 and 127 are vertically separated from the boundary DA_B by the third distance D3 greater than the second distance D2, and the fourth and eighth pads 124 and 128 are vertically separated from the boundary DA_B by the fourth distance D4 greater than the third distance D3.

The connection lines includes a first connection line CL1, a second connection line CL2, a third connection line CL3, a fourth connection line CL4, a fifth connection line CL5, a sixth connection line CL6, a seventh connection line CL7 and an eighth connection line CL8. The first connection line CL1 connects the first data line DL1 to the first pad 121, the second connection line CL2 connects the second data line DL2 to the second pad 122, the third connection line CL3 connects the third data line DL3 to the third pad 123, the fourth connection line CL4 connects the fourth data line DL4 to the fourth pad 124, the fifth connection line CL5 connects the fifth data line DL5 to the fifth pad 125, sixth connection line CL6 connects the sixth data line DL6 to the sixth pad 126, the seventh connection line CL7 connects the seventh data line DL7 to the seventh pad 127, and the eighth connection line CL8 connects the eighth data line DL8 to the eighth pad 128.

In an exemplary embodiment, the first connection line CL1 has a first length D1, the second connection line CL2 has a second length D2 greater than the first length D1, the third connection line CL3 has a third length D3 greater than the second length D2 and the fourth connection line CL4 has a fourth length D4 greater than the third length D3.

Each of the first to fourth connection lines CL1, CL2, CL3 and CL4 has a different line width to maintain a same line resistance. When a line length of one of the first to fourth connection lines CL1, CL2, CL3 and CL4 is increased, the line width of lengthened connection line may be increased to maintain a same line resistance. For example, the first connection line CL1 has a first width W1, the second connection line CL2 has a second width W2 greater than the first width W1, the third connection line CL3 has a third width W3 greater than the second width W2, and the fourth connection line CL4 has a fourth width W4 greater than the third width W3. As described above, each of the fifth to eighth connection lines CL5, CL6, CL7 and CL8 also has a different width to maintain the same line resistance.

According to embodiments of the present disclosure, data lines disposed in a display area and pads disposed in a peripheral area are connected by the connection lines having the same line resistance, to prevent signal distortion. In addition, the pads are arranged in a plurality of rows so that a contact area of the pads with bumps of the data driving part may be increased to improve driving reliability.

The foregoing is illustrative of embodiments of the present disclosure and is not to be construed as limiting thereof. Although a few exemplary embodiments of the present disclosure have been described, those skilled in the art will readily appreciate that many modifications are possible in the exemplary embodiments without materially departing from the novel teachings and features of the present disclosure. Therefore, it is to be understood that the foregoing is illustrative of the embodiments of the present disclosure and is not to be construed as limited to the specific exemplary embodiments disclosed, and that modifications to the disclosed exemplary embodiments, as well as other exemplary embodiments, are intended to be included within the scope of the appended claims. The present disclosure is defined by the following claims, with equivalents of the claims to be included therein.

What is claimed is:

1. A multi-primary color display device comprising:

a unit pixel part disposed on a display area that includes four subpixels;

a plurality of data lines that includes first, second, third, and fourth data lines extending in a first direction on the display area, and electrically connected to the subpixels;

a plurality of pads includes first, second, third, and fourth pads arranged in a second direction substantially perpendicular to the first direction on a peripheral area surrounding the display area, and electrically connected to a driving chip; and a plurality of connection lines that includes first, second, third, and fourth connection lines that connect the plurality of data lines to the plurality of pads disposed on the peripheral area, wherein the first connection lines has a first length and first width, the second connection line has a second length greater than the first length and second width greater than the first width, the third connection line has a third length greater than the second length and a third width greater than the second width, and the fourth connection line has a fourth length greater than the third length and fourth width greater than the third width, and wherein each of the connection lines has a same line resistance.

2. The multi-primary color display device of claim 1, wherein the unit pixel part includes a red subpixel, a green subpixel, a blue subpixel and a multi-primary subpixel.

3. The multi-primary color display device of claim 2, wherein the multi-primary subpixel represents at least one of white, yellow, cyan or magenta.

4. The multi-primary color display device of claim 2, wherein at least one of the four subpixels has an aperture area different from the remaining subpixels.

5. The multi-primary color display device of claim 2, wherein at least one of the subpixels has a pixel size different from the remaining subpixels.

6. The multi-primary color display device of claim 2, wherein the red subpixel is electrically connected to the first data line, the green subpixel is electrically connected to the second data line, the blue subpixel is electrically connected to the third data line and the multi-primary subpixel is electrically connected to the fourth data line.

7. The multi-primary color display device of claim 6, wherein the first connection line electrically connects the first data line to the first pad, the second connection line electrically connects the second data line to the second pad, the third connection line electrically connects the third data line to the third pad, and the fourth connection line electrically connects the fourth data line to the fourth pad.

8. The multi-primary color display device of claim 7, wherein the first, second, third and fourth pads are arranged along a diagonal with respect to the first direction.

9. The multi-primary color display device of claim 8, wherein each of the first, second, third and fourth pads has a first side and a second side opposite to the first side, the first sides and the second sides of the pads extend parallel with each other along said first direction, and a distance between two adjacent sides in the second direction is less than a subpixel width.

10. The multi-primary color display device of claim 8, wherein the first, second, third and fourth pads are arranged along the first direction.

11. The multi-primary color display device of claim 1, wherein the driving chip uniformly provides data voltages of a positive polarity (+) and a negative polarity (−) with respect to a reference voltage to the same color subpixels during one frame.

12. The multi-primary color display device of claim 11, wherein the driving chip provides voltages having an inversion period of positive (+), negative (−), positive (+), negative (−), negative (−), positive (+), negative (−) and positive (+), or negative (−), positive (+), negative (−), positive (+), positive (+), negative (−), positive (+) and negative (−), to the subpixels included in at least two unit pixel parts.

13. A multi-primary color display device comprising:

a unit pixel part disposed on a display area that includes a red subpixel, a green subpixel, a blue subpixel and at least one multi-primary subpixel; and a plurality of pads arranged in a first direction on a peripheral area surrounding the display area that are electrically connected to a driving chip and to the subpixels, wherein each subpixel is associated with a pad, a plurality of connection lines that includes first, second, third, and fourth connection lines that are connected to the plurality of pads disposed on the peripheral area, wherein the first connection line has a first length and a first width, the second connection line has a second length greater than the first length and a second width greater than the first width, the third connection line has a third length greater than the second length and a third width greater than the second width, and the fourth connection line has a fourth length greater than the third and the fourth width greater than the third width, wherein each of the connection lines has a same line resistance, wherein the plurality of pads includes first, second, third, and fourth pads, each of the first, second, third and fourth pads has a first side and a second side opposite to the first side, the first sides and the second sides of the pads extend parallel with each other along a second direction substantially perpendicular to the first direction, and a distance between two first sides of adjacent pads in the first direction is greater than zero and less than a pad width of each of the adjacent pads.

14. The multi-primary color display device of claim 13, further comprising a plurality of data lines extending in said second direction on the display area that are electrically connected to the subpixels, including first, second, third, and fourth data lines, wherein the red subpixel is electrically connected to the first data line, the green subpixel is electrically connected to the second data line, the blue subpixel is electrically connected to the third data line and the multi-primary subpixel is electrically connected to the fourth data line, wherein the first connection line electrically the first data line to the first pad, the second connection line electrically connects the second data line to the second pad, the third connection line electrically connects the third data line to the third pad, and the fourth connection line electrically connects the fourth data line to the fourth pad, and wherein each of the connection lines has a same line resistance.

15. The multi-primary color display device of claim 13, wherein the first, second, third and fourth pads are arranged along a diagonal with respect to the second direction.

16. The multi-primary color display device of claim 13, wherein the first, second, third and fourth pads are arranged along the second direction.

17. The multi-primary color display device of claim 13, wherein the multi-primary subpixel represents at least one of white, yellow, cyan or magenta.

* * * * *